United States Patent [19]

Brown

[11] 4,018,350

[45] Apr. 19, 1977

[54] HYDRAULIC CYLINER SYSTEMS WITH SAFEGUARDED FLOAT ACTION

[75] Inventor: Wilburn Kelly Brown, Morton Grove, Ill.

[73] Assignee: Pettibone Corporation, Chicago, Ill.

[22] Filed: Mar. 17, 1975

[21] Appl. No.: 558,782

[52] U.S. Cl. ..... 214/140; 91/447

[51] Int. Cl.² ..... E02F 3/70

[58] Field of Search ..... 214/130, 140, 778; 91/420, 447

[56] References Cited

UNITED STATES PATENTS

| | | | |
|---|---|---|---|
| 3,381,587 | 5/1968 | Parquet | 91/447 |
| 3,454,176 | 7/1969 | Landeborg et al. | 214/778 |
| 3,613,508 | 10/1971 | Krehbiel et al. | 91/420 |
| 3,788,401 | 1/1974 | Scheidt et al. | 91/447 |
| 3,908,515 | 9/1975 | Johnson | 91/447 |

*Primary Examiner*—Robert J. Spar
*Assistant Examiner*—Ross Weaver
*Attorney, Agent, or Firm*—Darbo, Robertson & Vandenburgh

[57] ABSTRACT

The invention may be used with a boom or the like which is raised and lowered by double-acting hydraulic cylinder means provided with a pilot-actuated safety valve at its bottom such that the boom can only go down when pilot pressure (normally from the downthrust line) is applied to this safety valve. The main manual valve has a four-position spool which provides a float position reached by moving through the lowering position. As the main valve is moved to the float position, its manual actuation mechanism actuates an auxiliary valve to supply pilot pressure to the safety valve to open the safety valve to allow the cylinder to achieve the desired floating action. This pilot pressure supply is through a shuttle valve which alternatively lets pilot pressure be applied to this safety valve as here stated or, from the downthrust, without ever connecting the two sources.

7 Claims, 4 Drawing Figures

Fig. 1
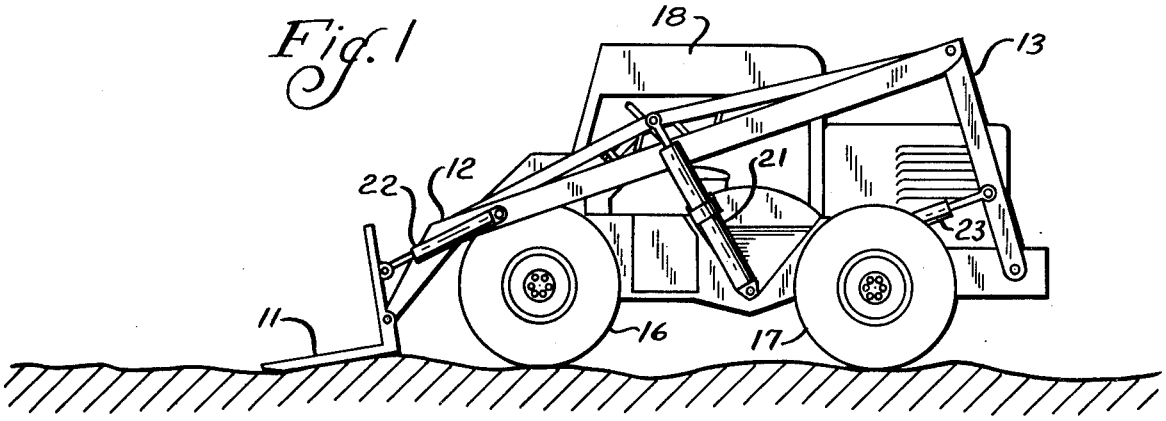
Fig. 2
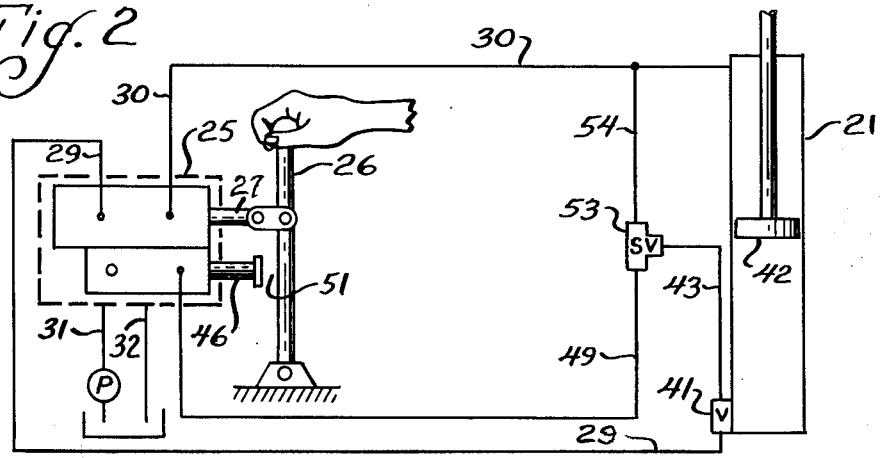
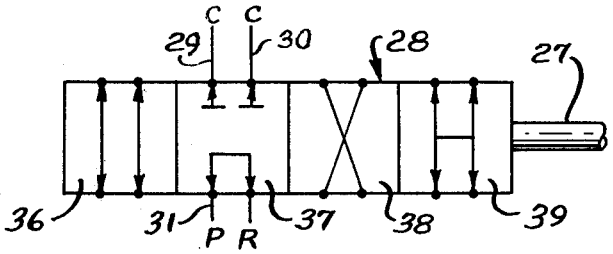
Fig. 3
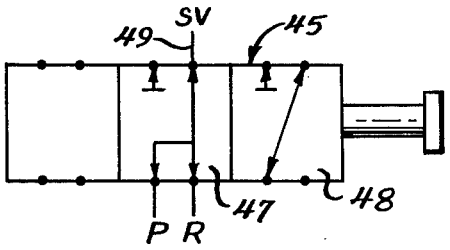
Fig. 4

HYDRAULIC CYLINER SYSTEMS WITH SAFEGUARDED FLOAT ACTION

INTRODUCTION

The invention of which the present disclosure is offered for public dissemination in the event that adequate patent protection is available relates to achieving a "float" or free-moving condition in hydraulically actuated equipment equipped with safety valves which tend to prevent that "float" condition. Modern safety requirements rigidly require the safety valve where otherwise a hydraulic failure or the like could let a heavy load or other equipment come down upon a workman.

The nature of such safety valves is that they prevent gravity-pressured outflow of oil from a lifting cylinder or the like. When the raised device is conventionally lowered by applying pressure to the down-drive port of the cylinder, a branch or pilot line carries this pressure as a pilot pressure to open the safety valve so that the oil can flow from beneath the piston in the cylinder to allow the equipment to move downwardly.

It has long been recognized that without the safety valve a manual "reversing" control valve could have a "float" position which would connect both sides of the cylinder to each other and to discharge so that the piston was free to move in either direction. Such "float" operation is recognized to have desirability under some conditions. For example, a fork-lift vehicle working on somewhat irregular terrain could let its fork device ride or float along the ground, accommodating itself to the irregularities of the terrain, while always being in a position to slide under a load. The modern rigid requirement for the safety valve has seemed to prevent this operation, because it would remain closed when the manual valve was at "float," thereby blocking the flow of oil which the float position was supposed to permit.

According to the present invention, an added spool is provided in the manual control valve block, and the manual operating lever or mechanism is changed so that as the main manual spool is moved into the float position, this operating mechanism will also move the added spool, and a pilot connection is provided to supply the necessary pilot pressure to the safety valve to open that valve. This requires some further contriving so that the two independent sources of pilot pressure (this new source and the old source) will not nullify each other by providing a bypass to discharge. This need is satisfied by the aid of a valve known as a shuttle valve which selects for connection to the pilot chamber of the safety valve whichever of the two sources has pressure, leaving that connection open for discharge of the pilot pressure from the pilot chamber until the other source is placed under pressure.

Advantages and details of the invention will be more apparent from the following description and from the drawings.

DESIGNATION OF FIGURES

FIG. 1 illustrates in side view one type of apparatus for which "float" operation is desirable.

FIG. 2 is a diagrammatic representation of the hydraulic system of the present invention.

FIGS. 3 and 4 are illustrations in the JIC (Joint Industry Committee) style of the hydraulic connections resulting from the four positions of the main manual control spool (FIG. 3) and the two positions of the supplemental spool (FIG. 4).

BACKGROUND DESCRIPTION

Although the following disclosure offered for public dissemination is detailed to ensure adequacy and aid understanding, this is not intended to prejudice that purpose of a patent which is to cover each new inventive concept therein no matter how others may later disguise it by variations in form or additions or further improvements. The claims at the end hereof are intended as the chief aid toward this purpose, as it is these that meet the requirement of pointing out the parts, improvements, or combinations in which the inventive concepts are found.

Although the float condition may be desired for a wide range of types of apparatus, FIG. 1 illustrates one type of apparatus with which the float condition has proved advantageous, namely a reaching fork-lift vehicle. In such a vehicle the fork device 11 (or other material handling device of ground-riding nature) is carried at the front end of a reaching link 13 pivoted at its lower end to the vehicle frame or chassis 14. The chassis is provided with front wheels 16 and rear wheels 17, at least one set of which is driven and at least one set of which is steerable. An operator seated in cab 18 drives the vehicle and also operates the hydraulic equipment. The hydraulic equipment includes lift cylinders 21, the one on the far side not being visible, and one or more fork-tilt cylinders 22. It also includes a reach cylinder 23, but the present invention is unlikely to be used in connection with it. The present invention is, however, desirable in connection with lift cylinders 21 and in connection with fork-tilt cylinders 22. The lift cylinder 21 can raise the fork device 11 high above the ground, and in that position the fork-tilt cylinder 22 can tilt the fork device 11 to let a load slide from it. As the angularity of the boom 12 changes, the cylinder 22 can be used to maintain the fork device 11 in a horizontal position.

The controls for cylinders 21 and 22 are similar and will be described with reference to cylinders 21. The lift cylinders 21 are controlled by the operator in cab 18 who operates valve assembly 25 by a control lever or handle manually. The control lever 26 actuates a plunger 27 which actuates a spool indicated diagrammatically at 28 in FIG. 3.

The valves represented by spool 28 are commonly called reversing valves because they can reverse the connections of the cylinder lines 29 and 30 to the pump lines 31 and 32, so that the pump pressure can be applied to either end of the controlled cylinder 21 while the other end is connected to discharge. These reversing valves commonly have three positions. In the case of the lift cylinder 21 these would be the positions represented at 36, 37 and 38 of spool 28 in FIG. 3. As those acquainted with these valves will readily realize, the spools are normally spring-centered so that if handle 26 is released, the valve will return to its neutral position represented by position 37 in FIG. 3, with the ports to lines 29 and 30 closed. If the handle 26 is pulled back, the spool 25 moves to the lift position represented by position 36 in FIG. 3. If from the neutral position 37 the handle 26 is thrust forwardly, the spool 28 is moved to the lowering position represented at 38 in FIG. 3.

When "float" action is desired, the spool 28 has a fourth position, represented as 39 in FIG. 3. This is beyond the lowering position so that if the handle 26 is thrust forwardly through the lowering position to the float position, the connections will be made as indicated at 39 in FIG. 3. Actually, the movements to accomplish the variety of connections indicated are very much less than the conventional diagramming of FIG. 3 would indicate. However, by visualizing the H-shaped connection pattern at position 39 moved to the position of position 37, it will be seen that two cylinder connections C, the connection P and the connections R are all connected together through the H. If for the moment we ignore safety valve 41, this would mean that hydraulic fluid is free to flow to and from each end of cylinder 21 so that its piston is free to move in either direction under the influence of external conditions, or in other words, to "float."

If it be assumed that the operator in cab 18 moves the handle 26 controlling lift cylinder 21 to the boom 12 until the fork device 11 rests on the ground, and that he then moves the handle 26 further forwardly to the float position, the irregularities of the ground can cause the boom 12 to move up and down as may be required for the fork device to ride up and down over the irregularities of the ground. If it be assumed that the operator at the same time pushes another control lever similar to control lever 26 to place the connections for fork-tilt cylinder 22 likewise in the float condition, the fork device 11 will be free to rock to lie flat along the ground, as a vehicle moves along the ground, in spite of the varying slopes resulting from the irregularities of the ground.

THE SAFETY VALVE PROBLEM

When in compliance with modern safety requirements the safety valve 41 is added at the bottom of cylinder 21, its normally closed condition will prevent the "float" operation just described. As indicated in FIG. 2, and as is necessary to meet some official requirements, the valve 41 is integrated with the lift port of the cylinder, as distinguished from being separate and connected by piping. A similar safety valve on cylinder 22 would also prevent its float operation. As those skilled in the industry well know, the safety valve 41 only opens to permit the flow of hydraulic fluid from beneath the piston 42 in cylinder 21 when pressure is applied through pilot line 43 to the pilot chamber of safety valve 41. The construction of safety valve 41 is such, however, that pressured fluid can flow in the opposite direction, from line 29 through valve 41 into the lower end of cylinder 21 at any time. This would be for raising the boom 12. When it is desired to lower the boom 12, by moving handle 26 forwardly to bring position 38 into operation, the pump connection 31 is connected to line 30 which extends to the upper end of cylinder 21. This tends to lower the piston 42 in cylinder 21 but such lowering would be prevented by valve 41 if it remained closed. However, the pressure in line 30 is not only supplied to the upper end of cylinder 21 but also through pilot line 43 to the pilot chamber of the valve 41, causing that valve to open, so that piston 42 can descend. The difficulty heretofore encountered with safety valve 41 was that it prevented the float operation which is sometimes quite desirable. Thus, with position 39 of FIG. 3 moved to the active position, both of lines 29 and 30 are connected to discharge R so that neither is supplied with the pressure for actuating the safety valve 41. The weight of the parts places the hydraulic fluid below the piston 42 under pressure, but this pressure cannot pass through the valve 41 because there is no pressure in the pilot line 43 to open this safety valve 41.

THE SUPPLEMENTAL SPOOL OF THE PRESENT INVENTION

According to the present invention, the float-thwarting difficulty just described is overcome by providing a supplemental spool 45 of FIG. 4 operated by a plunger 46. The spool 45 may be a conventional three-position spool known as a "B-motor spool" but only two positions are used, these being represented as 47 and 48 in FIG. 4. The spool 45 is spring-returned to the neutral position represented at 47, which in this instance provides open-neutral connections so that the only output line from the spool, line 49, is connected to discharge or return R so that no pressure is applied to line 49. As diagrammatically indicated by the lost motion space 51 in FIG. 2, the plunger 46 will be engaged by the lever 26 after the plunger 27 has passed through the center of its lowering position 38. In other words, as the plunger 27 moves the spool 25 into its float position 39, the spool 45 will likewise be moved into its position 48 which might be called the pilot-actuating position or the float-restoring position. This connects the pump line 31 to the output line 49 which leads eventually to the pilot line 43 for opening the safety valve 41 so that the float conditions are achieved.

It is not permissible to have both of lines 30 and 49 in constant and open communication with the pilot line 43 because the pressure from either line 29 or line 49 could then be discharged through the other of these two lines instead of providing the pilot pressure required in pilot line 43. This difficulty is overcome by using a valve 53 of a type known as a shuttle valve. This valve is so constructed that when pressure is supplied from line 29 through line 54 to one port of the shuttle valve, its valving member will be shifted by that pressure to open the connection from line 54 to pilot line 43 while closing the connection from line 49 through valve 53. Thus the pressure from line 29 through line 54 is supplied to pilot line 43 and the valve 41 is opened to permit the lowering of piston 42 and the boom. Likewise, if pressure is supplied through line 49 to the shuttle valve 53, that pressure actuates the valving member of valve 53 to its opposite position, closing the connection to line 54 and connecting line 49 to pilot line 43.

Thus when the handle 26 is thrust forward to the float position, the section 48 of supplemental spool 45 connects pump pressure through line 49 and shuttle valve 53 to pilot line 43 thereby opening the pilot valve 41. At the same time, section 39 of main spool 25 connects both of lines 29 and 30 to return so that fluid is free to flow to or from either end of cylinder 21 and the boom can move up and down as may be required by the riding of the fork device 11 up and down over irregularities of the ground.

In the same way, if similar equipment is provided for the cylinder 22, as is preferred, its handle corresponding to 26 may be thrust all of the way forward to permit the float action of cylinder 22 which permits the fork device 11 to rock as may be required so as to lie relatively flat along varying slopes of the ground, as the vehicle of FIG. 1 moves along the ground. A slight variation from the FIG. 2 hydraulic circuitry would be involved, inasmuch as the position for safety valve 41 in connection with cylinder 22 would be at the piston rod end of cylinder 22. This results from the fact that a load on float device 11 would tend to force oil out of that end of cylinder 22. This safety device at the rod end of cylinder 22 therefore prevents the load in the fork device 11 from being dumped unintentionally. Thus for both of cylinders 21 and 22, the safety valve is at the gravity-pressurized port.

Of course, the float device 11 may be replaced by any other material handling device such as a bucket.

FLOAT VALVE UNIT

The valve assembly 25 with its special actuating mechanism is a new combination so far as known. Such multiple-spool valve assemblies are well known, the Vickers CM2 valve being an appropriate example. They include sophisticated details, not shown. For example, they make pressure available at a secondary spool even when the primary spool is at a position conventionally diagrammed (with over-simplification) as connecting pressure to return. Their conventional disposition with the spools beside one another at the same level would probably be used, in which case the lever 26 could carry a laterally-extending arm to give the lost-motion actuation of plunger 46 as diagrammatically shown.

ACHIEVEMENT

It is apparent from the foregoing that the present invention makes possible the "float" actuation of a hydraulic cylinder apparatus even when safety requirements compel equipping it with a safety valve requiring pilot pressure for a lowering operation.

I claim:

1. A hydraulic cylinder system with safeguarded float action, including:

as environment for the invention, double-acting load-lifting cylinder means having a lift port internally subject to pressure from the lifted load, and an opposite port; a pilot-actuated safety valve for the lift port integrated with the lift port, a lift-port line connected to the lift port through the safety valve, an opposite-port line connected to the opposite port, a reversing valve for controlling connection of pressure-source and return connections to said lines, biased to a neutral position, movable from the neutral position in one direction to a load-lifting position and in the opposite direction to a load-lowering position, and by this invention, said reversing valve having a float position in which the lines are connected together and to a discharge connection; and said reversing valve unit having associated therewith a supplemental valve unit, biased to a neutral position and moved, when the reversing valve is moved to float position, to connect a third line to a pressure-source connection; and said system having a shuttle valve responsive to pressure in either the opposite-port line or the third line for connecting that line to the safety valve to provide a pilot pressure for releasing the safety valve so that hydraulic fluid can flow through the lift port to and from the lift-port line.

2. A hydraulic cylinder system with safeguarded float action, including:

as environment for the invention, double-acting load-lifting cylinder means having a lift port internally subject to pressure from the lifted load, and an opposite port; a pilot-actuated safety valve for the lift port integrated with the lift port, a lift-port line connected to the lift port through the safety valve, an opposite-port line connected to the opposite port, a reversing valve for controlling connection of pressure-source and return connections to said lines, biased to a neutral position, movable from the neutral position in one direction to a load-lifting position and in the opposite direction to a load-lowering position, and by this invention, said reversing valve having a float position in which the lines are connected together and to a discharge connection; and said reversing valve unit having associated therewith a supplemental valve unit, biased to a neutral position and moved, when the reversing valve is moved to float position, to connect a third line to a pressure-source connection; and said system having a shuttle valve responsive to pressure in either the opposite-port line or the third line for connecting that line to the safety valve to provide a pilot pressure for releasing the safety valve so that hydraulic fluid can flow through the lift port to and from the lift-port line;

said supplemental valve unit remaining in its neutral position at all times except when the reversing valve unit is moved to its float position.

3. The combination of a vehicle having a load-lifting structure and a hydraulic cylinder system according to claim 1 for raising the structure to lift a load and for lowering it to allow a load to ride on the surface supporting the vehicle as it moves while the float action allows the structure to shift as determined by irregularities of said surface.

4. The combination of a vehicle having a load-lifting structure, a flat-bottomed load-handling unit pivoted thereto and raised and lowered thereby, and a pair of hydraulic cylinder systems each according to claim 1, for raising the structure to lift a load and for lowering it, and for raising the angle of the unit and for lowering it, to allow a load to ride on the surface supporting the vehicle as it moves while the float action allows the structure to shift as determined by irregularities of said surface.

5. A hydraulic cylinder system with safeguarded float action, including:

as environment for the invention, load-lifting cylinder means having a lift port internally subject to pressure from the lifted load; a pilot-actuated safety valve for the lift port integrated with the lift port, a lift-port line connected to the lift port through the safety valve, a pilot line connected to the safety valve to operate it for lowering, control valve means for controlling connection of pressure-source and return connections to said lines, biased to a neutral position, movable from the neutral position in one direction to a load-lifting position and in the opposite direction to a load-lowering position, and by this invention, said control valve means having a float position in which the lift line is connected to a discharge connection, and pilot pressure is supplied to the safety valve independently of pressure to the cylinder means for releasing the safety valve so that hydraulic fluid can flow through the lift port to and from the lift-port line, said control valve means being effective in a position other than its float position to remove the pilot pressure from the safety valve.

6. Valve apparatus including valve-block means, a main spool slidable therein and having successive positions for a first direction pressure and return connection, neutral, a reversed direction pressure and return connection, and float; a secondary spool shiftable in the block means and having a normal position for connecting an output port to return and a second position connecting said port to pressure; operating means for moving the main spool to its successive positions, and a lost-motion mechanism effective as the main spool is moved to its float position to move the secondary spool from its normal position to its second position.

7. A hydraulic cylinder system with safeguarded float action, including:

as environment for the invention, double-acting load-lifting cylinder means having a lift port internally subject to pressure from the lifted load, and an opposite port; a pilot-actuated safety valve for the lift port integrated with the lift port, a lift-port line connected to the lift port through the safety valve, an opposite-port line connected to the opposite port, a reversing valve for controlling connection of pressure-source and return connections to said lines, biased to a neutral position, movable from the neutral position in one direction to a load-lifting position and in the opposite direction to a load-lowering position, and by this invention, said reversing valve having a float position in which the lines are connected together and to a discharge connection; and said reversing valve unit having associated therewith a supplemental valve unit, biased to a neutral position and moved, when the reversing valve is moved to float position, to connect a third line to a pressure-source connection; and said system having a shuttle valve responsive to pressure in either the opposite-port line or the third line for connecting that line to the safety valve to provide a pilot pressure for releasing the safety valve so that hydraulic fluid can flow through the lift port to and from the lift-port line, said supplemental valve, when returned to its neutral position, connecting its third line to discharge to remove the pilot pressure from the safety valve if the shuttle valve is not actuated by pressure from the opposite-port line.

* * * * *